US009753409B2

(12) United States Patent
Iketani

(10) Patent No.: US 9,753,409 B2
(45) Date of Patent: Sep. 5, 2017

(54) TONER CASE AND IMAGE FORMING APPARATUS

(71) Applicant: KYOCERA Document Solutions Inc., Osaka (JP)

(72) Inventor: Takeshi Iketani, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/173,166

(22) Filed: Jun. 3, 2016

(65) Prior Publication Data

US 2016/0363888 A1 Dec. 15, 2016

(30) Foreign Application Priority Data

Jun. 11, 2015 (JP) ..... 2015-118657

(51) Int. Cl.
*G03G 15/08* (2006.01)

(52) U.S. Cl.
CPC ..... *G03G 15/0896* (2013.01); *G03G 15/0865* (2013.01); *G03G 15/0875* (2013.01)

(58) Field of Classification Search
CPC ..... G03G 15/0896; G03G 15/0865; G03G 15/0875
See application file for complete search history.

(56) References Cited

U.S. PATENT DOCUMENTS 4,977,429 A * 12/1990 Tani ..... G03G 15/0849 399/13
8,693,927 B2 4/2014 Morita
9,354,547 B2 * 5/2016 Konishi ..... G03G 15/0831
9,454,125 B1 * 9/2016 Bejat ..... G03G 21/10
2003/0223776 A1 * 12/2003 Kato ..... G03G 21/12 399/120
2011/0170912 A1 * 7/2011 Taniguchi ..... G03G 15/0894 399/262
2014/0079438 A1 * 3/2014 Abler ..... G03G 15/0875 399/262
2014/0079440 A1 * 3/2014 Abler ..... G03G 15/08 399/262
2016/0062268 A1 * 3/2016 Nakaue ..... G03G 15/0886 399/262

FOREIGN PATENT DOCUMENTS

JP 2012-230350 A 11/2012

* cited by examiner

*Primary Examiner* — Rodney Bonnette
(74) *Attorney, Agent, or Firm* — Studebaker & Brackett PC

(57) ABSTRACT

A toner case includes a case main body, an attachment member, and a sealing member. The case main body is configured to contain a toner. The attachment member is configured to partition an inside space of the case main body so as to adjust toner capacity. The sealing member is arranged between the case main body and the attachment member. The case main body includes a first engagement part. The attachment member includes a second engagement part configured to engage with the first engagement part via the sealing member.

10 Claims, 9 Drawing Sheets

TONER CASE AND IMAGE FORMING APPARATUS

INCORPORATION BY REFERENCE

This application is based on and claims the benefit of priority from Japanese patent application No. 2015-118657 filed on Jun. 11, 2015, the entire contents of which are incorporated herein by reference.

BACKGROUND

The present disclosure relates to a toner case configured to contain a toner (a developer) and an image forming apparatus including the toner case.

In an electrographic image forming apparatus, an electrostatic latent image formed on a surface of a photosensitive drum or the like is developed to a toner image by a development device. To the development device, a toner is supplied from a toner case, such as a toner container or a middle hopper.

For example, there is a toner case including a case main body configured to contain a toner, a toner discharging port arranged at the case main body, a conveying screw configured to convey the toner to the toner discharging port, and an agitating paddle configured to agitate the toner inside the case main body.

SUMMARY

In accordance with an embodiment of the present disclosure, a toner case includes a case main body, an attachment member, and a sealing member. The case main body is configured to contain a toner. The attachment member is configured to partition an inside space of the case main body so as to adjust toner capacity. The sealing member is arranged between the case main body and the attachment member. The case main body includes a first engagement part. The attachment member includes a second engagement part configured to engage with the first engagement part via the sealing member.

In accordance with an embodiment of the present disclosure, an image forming apparatus includes the above-mentioned toner case.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to drawings, an image forming apparatus and a toner case according to an embodiment of the present disclosure will be described.

Figure 1:
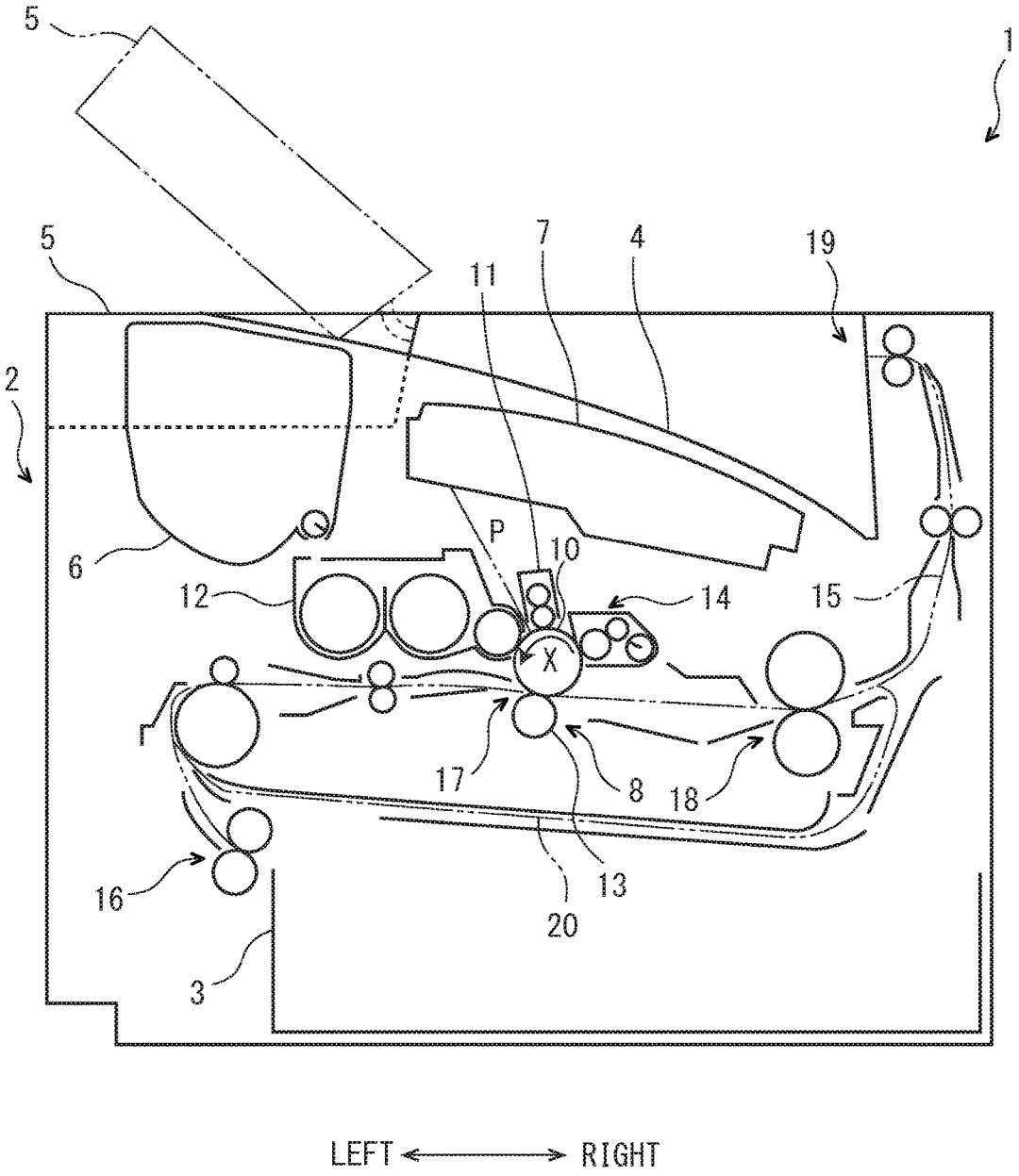
FIG. 1 is a schematic view showing an outline of a printer according to an embodiment of the present disclosure.

First, with reference to FIG. 1, an entire structure of a printer 1 (an image forming apparatus) will be described. FIG. 1 is a schematic view showing an outline of the printer 1. Hereinafter, a near side of sheet in FIG. 1 will be described as a front side, and a direction of left or right side will be described so that a direction seen from the front side is set as a standard.

The printer 1 includes a box-like formed printer main body 2. In a lower part of the printer main body 2, a sheet feeding cartridge 3 storing a sheet (recording medium) is installed and, on a top face of the printer main body 2, a sheet ejecting tray 4 is arranged. To the top face of the printer main body 2, an upper cover 5 is openably/closably attached at a lateral side of the sheet ejecting tray 4 and, below the upper cover 5, a toner case 6 is detachably attached.

In an upper part of the printer main body 2, an exposure device 7 composed of a laser scanning unit (LSU) is located below the sheet ejecting tray 4. Below the exposure device 7, an image forming part 8 is arranged. In the image forming part 8, a photosensitive drum 10 as an image carrier is rotatably arranged. Around the photosensitive drum 10, a charger 11, a development device 12, a transfer roller 13 and a cleaning device 14 are located along a rotating direction (refer to an arrow X in FIG. 1) of the photosensitive drum 10.

Inside the printer main body 2, a conveying path 15 for the sheet is arranged. At an upstream end of the conveying path 15, a sheet feeding part 16 is positioned. At an intermediate stream part of the conveying path 15, a transferring part 17 composed of the photosensitive drum and the transfer roller 13 is positioned. At a downstream part of the conveying path 15, a fixing device 18 is positioned. At a downstream end of the conveying path 15, a sheet ejecting part 19 is positioned. Below the conveying path 15, an inversion path 20 for duplex printing is arranged.

Next, image forming operation of the printer 1 having such a configuration will be described. First, a surface of the photosensitive drum 10 is electrically charged by the charger 11. Then, exposure corresponding to the image data is carried out to the photosensitive drum 10 by a laser light (refer to a two-dot chain line P in FIG. 1) from the exposure device 7, thereby forming an electrostatic latent image on the surface of the photosensitive drum 10. Subsequently, the development device 12 develops the electrostatic latent image to a toner image by a toner (a developer) supplied from the toner case 6.

On the other hand, a sheet fed from the sheet feeding cartridge 3 by the sheet feeding part 16 is conveyed to the transferring part 17 in a suitable timing for the above-mentioned image forming operation, and then, the toner image on the photosensitive drum 10 is transferred onto the sheet in the transferring part 17. The sheet with the transferred toner image is conveyed to a downstream side of the conveying path 15 and enters the fixing device 18, and then, the toner image is fixed onto the sheet in the fixing device 18. The sheet with the fixed toner image is ejected from the sheet ejecting part 19 to the sheet ejecting tray 4. The toner remained on the photosensitive drum 10 is collected by the cleaning device 14.

Figure 2:
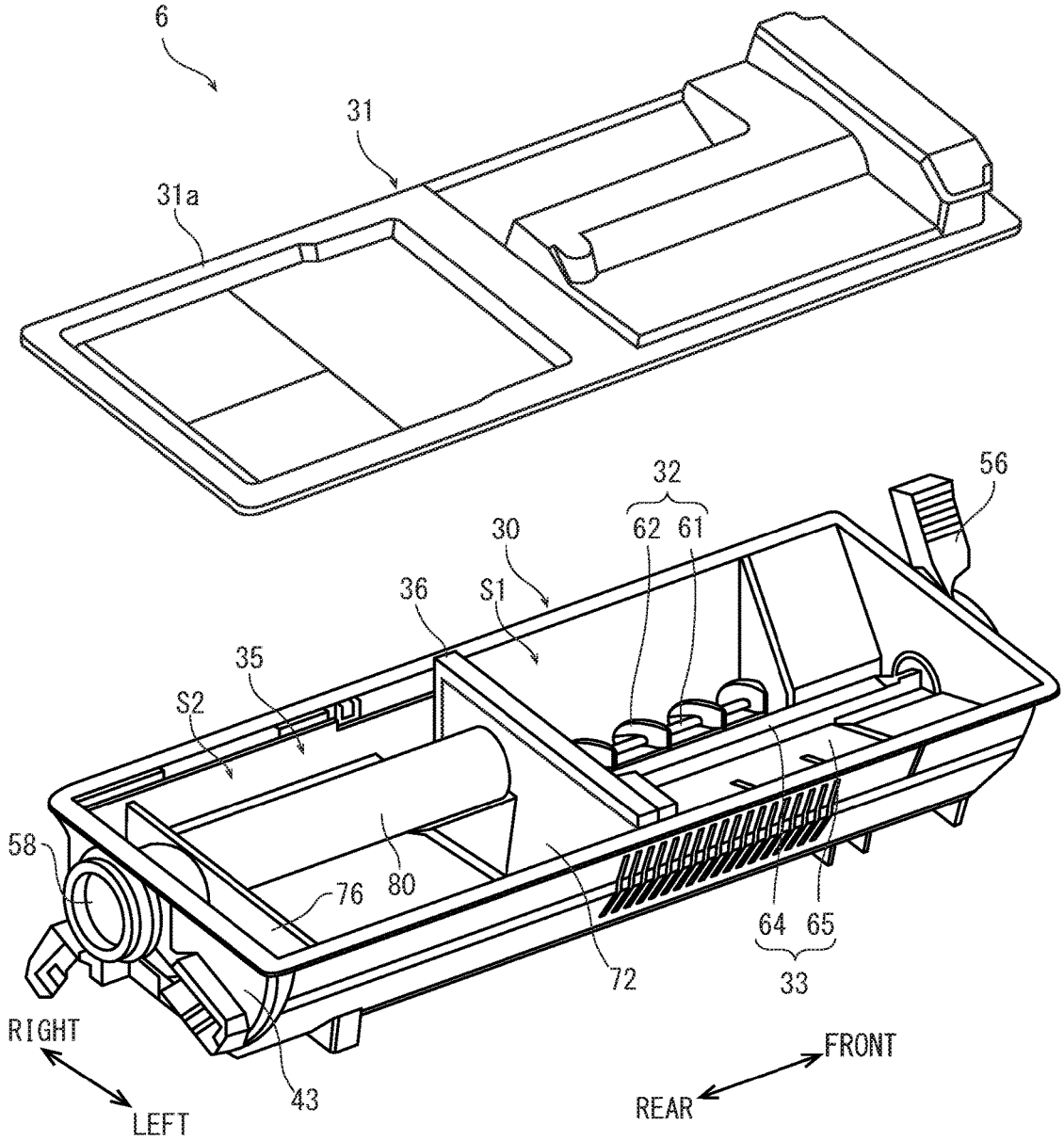
FIG. 2 is an exploded perspective view showing a toner case according to the embodiment of the present disclosure.
Figure 4A:
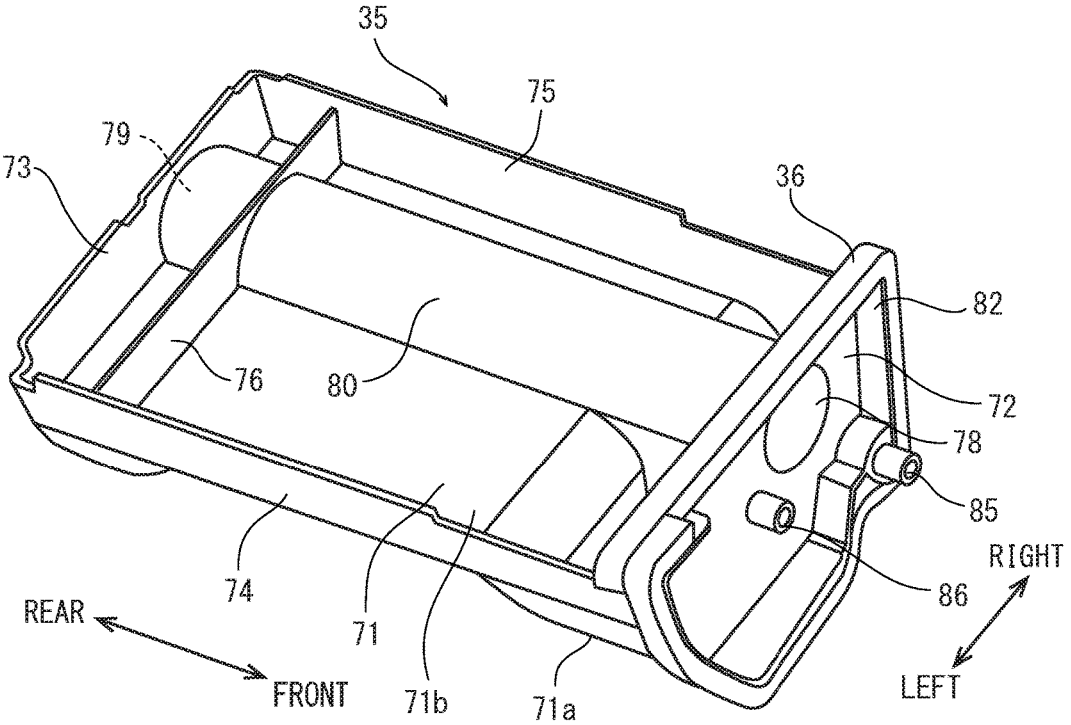
FIG. 4A is a perspective view seen from an upper side and showing an attachment member and a sealing member of the toner case according to the embodiment of the present disclosure.
Figure 4B:
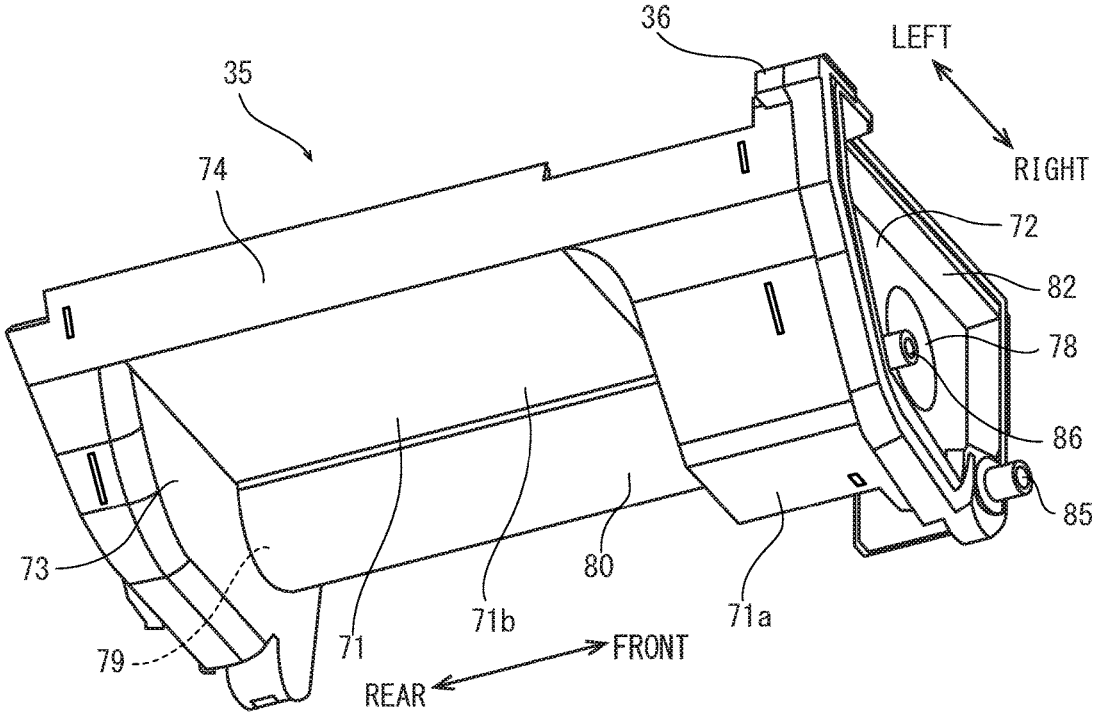
FIG. 4B is a perspective view seen from a lower side and showing the attachment member and the sealing member of the toner case according to the embodiment of the present disclosure.
Figure 5:
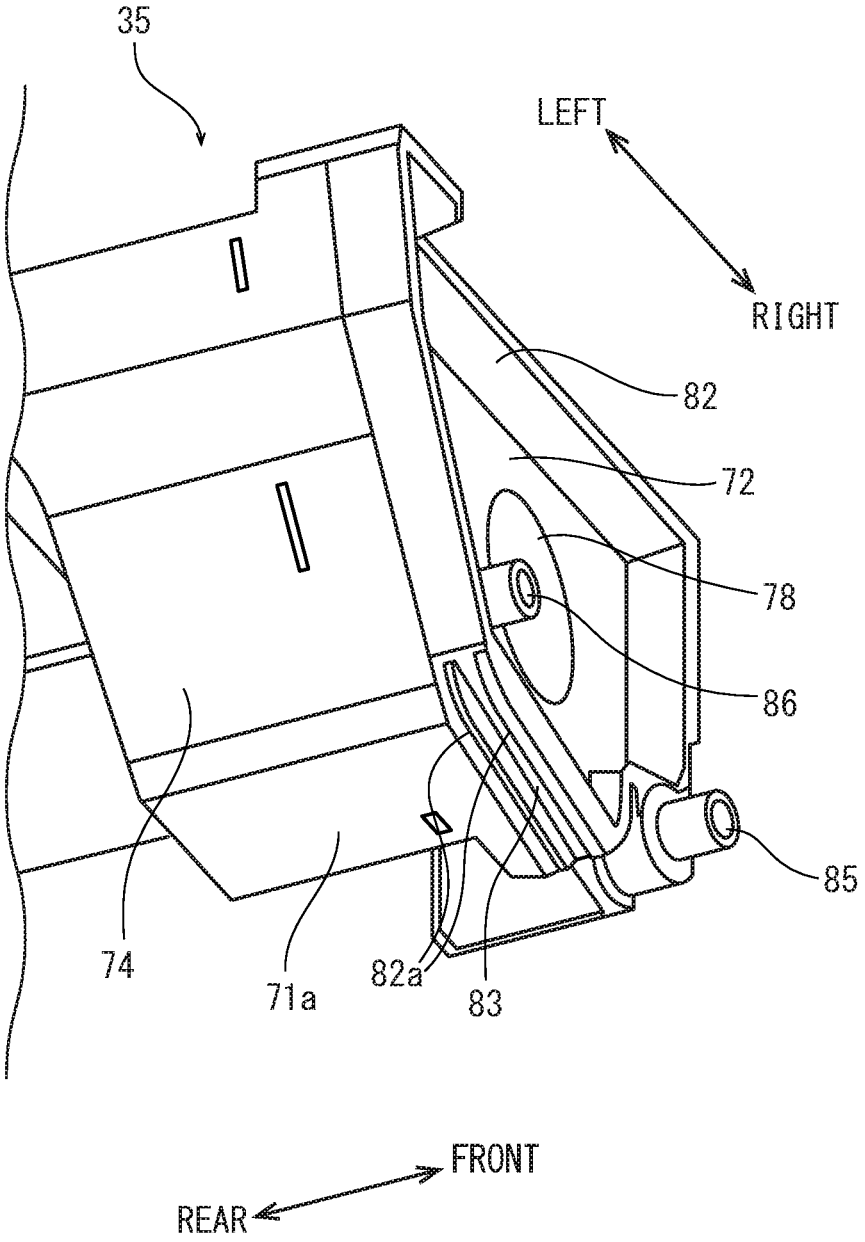
FIG. 5 is a perspective view showing a front end part of the attachment member of the toner case according to the embodiment of the present disclosure.

Next, the toner case 6 will be described with reference to FIGS. 2 to 5. FIG. 2 is an exploded perspective view of a toner case, FIG. 3 is a perspective view of a case main body, FIGS. 4A and 4B are perspective views of an attachment member and a sealing member, and FIG. 5 is a perspective view of a front plate of the attachment member.

As shown in FIG. 2, the toner case 6 includes a case main body 30 in which a toner is contained, a lid member 31 which closes the case main body 30, a conveying screw 32 (a rotating member) which conveys a toner in the case main body 30, a agitating paddle 33 (a rotating member) which agitates the toner, an attachment member 35 which partitions an inside space of the case main body 30, and a sealing member 36 which is arranged between the case main body 30 and the attachment member 35.

Figure 3:
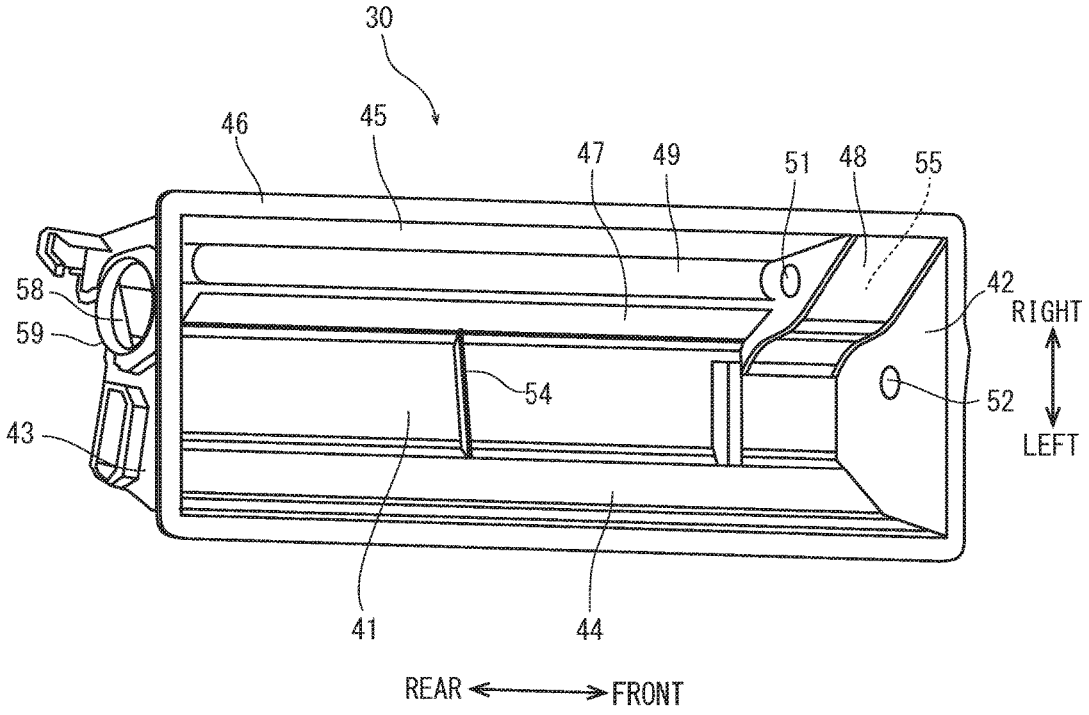
FIG. 3 is a perspective view showing a case main body of the toner case according to the embodiment of the present disclosure.

As shown in FIG. 3, the case main body 30 has a box shape whose upper face is opened and is thinly elongated in a front and rear direction, and includes a bottom plate 41, a front plate 42 and a rear plate 43 (outer plate) of nearly semi-circular shapes, and left and right side plates 44 and 45. The bottom plate 41 has a curved shape which is protruded downward, the left side plate 44 is slightly curved into an arc shape from a left rim of the bottom plate 41 to an outer direction and is inclined in an upper left direction, and the right side plate 45 is inclined from a right rim of the bottom plate 41 to an upper right direction. In surroundings of an opening of the upper face, a flange part 46 which is protruded outward is formed.

On the right side plate 45, a step part 47 which extends in the front and rear direction, and a toner discharge chamber 48 which is partitioned from the inside space of the case main body 30 and formed at a front side of the step part 47 are formed. In an upper face of the step part 47, a conveying groove 49 of a semi-circular shape into which a toner is conveyed is formed. In a rear face of the toner discharge chamber 48, a toner conveying opening 51 is formed to meet the conveying groove 49, and, in a lower face of the toner discharge chamber 48, a discharge port 55 which supplies the toner to the development device 12 is formed. The discharge port 55 is closed by a slide-type shutter (not shown) in a state where the toner case 6 is not attached to the printer main body 2. The shutter is configured to be slid by a lever (see FIG. 2) to open the discharge port 55, and to communicate the inside space of the toner case 6 and an inside space of the development device 12.

In an inner face of the bottom plate 41 (a lower part of an inner circumferential face of the case main body 30), and in a nearly center in the front and rear direction, a protruded part 54 (first engagement part) of a flat piece shape is formed. The protruded part 54 extends along a left and right direction (a direction crossing (orthogonal) to a longitudinal direction of the case main body 30). The protruded part 54 is protruded from the inner circumferential face of the case main body 30.

In a nearly center part of the front plate 42, a paddle axis hole 52 is formed. At a position close to a right side of the rear plate 43, a circular toner filling port 58 is formed. Around the toner filling port 58, an annular outer circumferential wall 59 protruded backward is formed.

As shown in FIG. 2, the lid member 31 closes the opening of the upper face of the case main body 30. The lid member 31 has a rectangular flat shape, and, in an upper face, a reinforcing recess and a reinforcing protrusion, and a grip are formed. Further, along an outer circumference of the lid member 31, a flange part 31*a* is formed.

As shown in FIG. 2, the conveying screw 32 includes a rotation axis 61 which extends in the front and rear direction, and a spiral fin 62 which is coaxially provided to an outer circumference of the rotation axis 61.

As shown in FIG. 2, the agitating paddle 33 includes a supporting frame 64 of a frame flat shape which extends in the front and rear direction, and an agitating vane 65 of a sheet shape which is supported by the supporting frame 64. The agitating vane 65 is formed by a synthetic resin sheet, such as a lumirror.

As shown in FIGS. 4A and 4B, the attachment member 35 has a box shape whose length in the front and rear direction is shorter than that of the case main body 30, and an outer circumferential face of the attachment member 35 is formed to meet an inner circumferential face of the case main body 30. The attachment member 35 includes a bottom plate 71, a front plate 72 (a partition plate), a rear plate 73 and left and right side plates 74 and 75. The bottom plate 71 is formed in a stepwise shape, and includes a front lower step part 71*a* and a rear upper step part 71*b*. The upper step part 71*b* is longer than the lower step part 71*a* in the front and rear direction, and a part between the lower step part 71*a* and the upper step part 71*b* is moderately curved. Further, at the upper step part 71*b* and at a position close to the back, a rib 76 parallel to the rear plate 73 is formed.

As shown in FIG. 2, the front plate 72 partitions the inside space of the case main body 30 into a filled space S1 formed at a front side of the front plate 72, and a restrained space S2 formed at a rear side of the front plate 72. In the filled space S1, the conveying screw 32 and the agitating paddle 33 are housed.

As shown in FIGS. 4A and 4B, the left side plate 74 is inclined from a left rim of the bottom plate 71 toward an upper left direction, and the right side plate 75 is inclined from a right rim of the bottom plate 71 toward an upper right direction.

In the front and rear plates 72 and 73, openings 78 and 79 which are coaxially circular in the front and rear direction are formed. In a state where the attachment member 35 is attached to the case main body 30, the opening 79 of the rear plate 73 meets the toner filling port 58 formed in the rear plate 43 of the case main body 30. The openings 78 and 79 of the front and rear plates 72 and 73 are communicated by a duct 80 of a cylindrical shape. As shown in FIG. 2, the duct 80 is provided between the rear plate 43 of the case main body 30 and the front plate 72 of the attachment member 35. The duct 80 is housed in the restrained space S2 of the case main body 30.

As shown in FIGS. 4A and 4B, in a front face of the front plate 72, an outer circumferential wall 82 which protrudes forward along an outer circumferential rim is formed. As shown in FIG. 5, in a lower face of the outer circumferential wall 82 (a lower part of an outer circumferential face of the outer circumferential wall 82), a recess part 83 (a second engagement part) is formed between two parallel flat pieces 82*a* extending along the left and right direction. The recess part 83 extends along the left and right direction (a direction crossing (orthogonal) to the longitudinal direction of the case main body 30). Further, in the front face of the front plate 72, and at a lower right corner and a lower left side of the opening 78, a screw axis hole 85 (bearing part) and a paddle axis hole 86 (bearing part) are formed.

The sealing member 36 has a thin tape shape, and is formed by a sponge or a urethane resin. As shown in FIGS. 4A and 4B, the sealing member 36 is attached along an entire circumference (including the recess part 83) of the outer circumferential wall 82 of the front plate 72 of the attachment member 35. The sealing member 36 is provided so as to cover the recess part 83 along the outer circumferential face of the outer circumferential wall 82 of the front plate 72. The sealing member 36 is wound around the outer circumferential face of the outer circumferential wall 82 of the front plate 72, and both end parts of the sealing member 36 in the longitudinal direction are partially overlapped with each other in the front and rear direction (the longitudinal direction of the case main body 30).

Figure 6A:
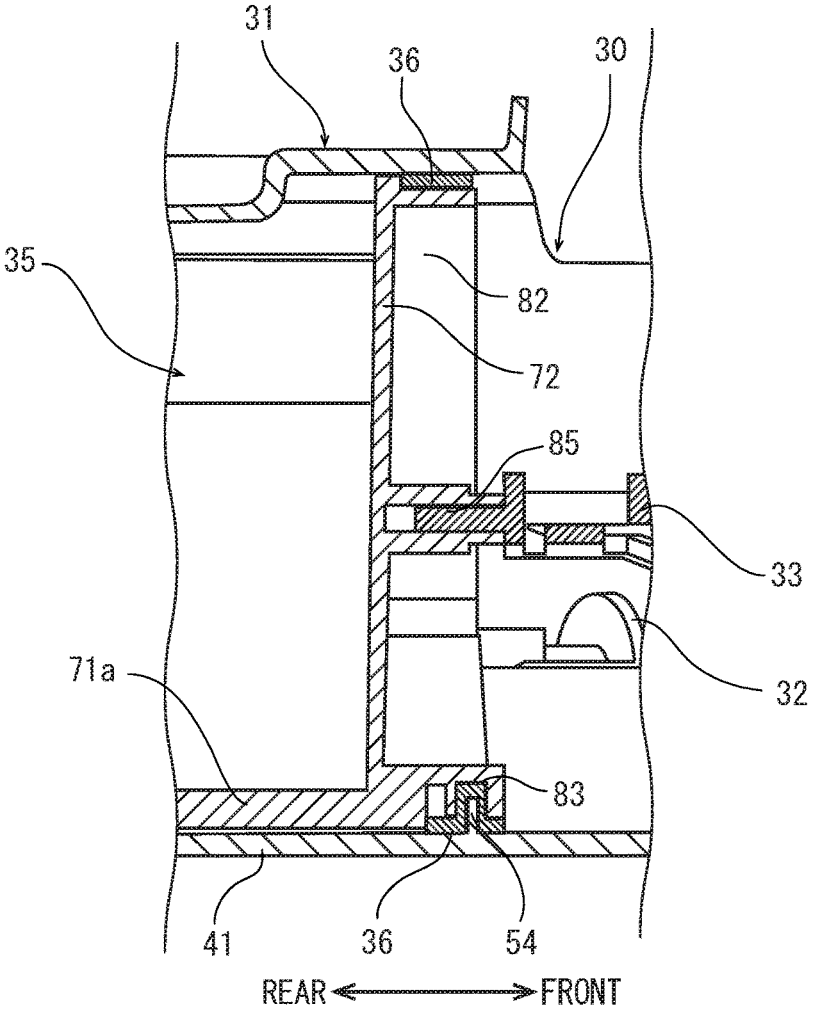
FIG. 6A is a side sectional view showing an engaging state of a protruded part of the case main body and a recess part of the attachment member in the toner case according to the embodiment of the present disclosure.
Figure 6B:
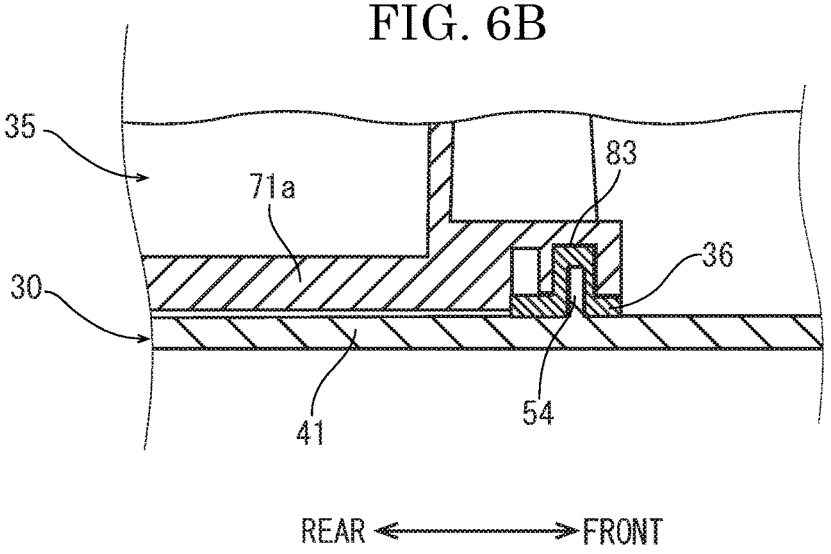
FIG. 6B is a side sectional view showing the engaging state in an enlarged way.
Figure 8:
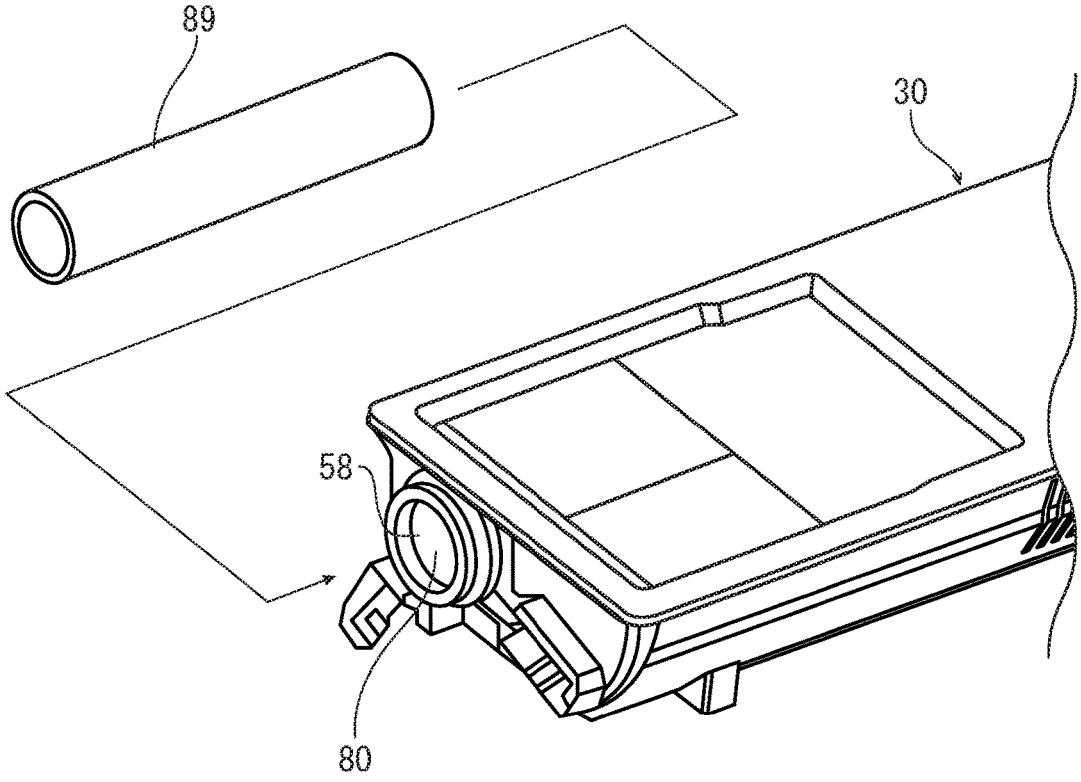
FIG. 8 is a perspective view showing the attachment member and a closing member in the toner case according to the embodiment of the present disclosure.
Figure 9A:
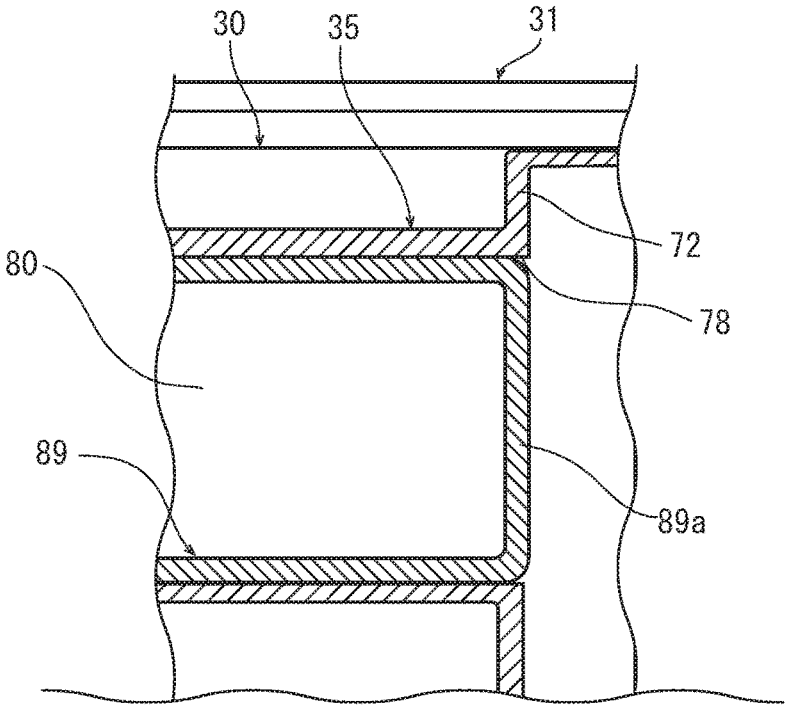
FIG. 9A is a side sectional view showing a state where an opening of the attachment member is closed in the toner case according to the embodiment of the present disclosure.
Figure 9B:
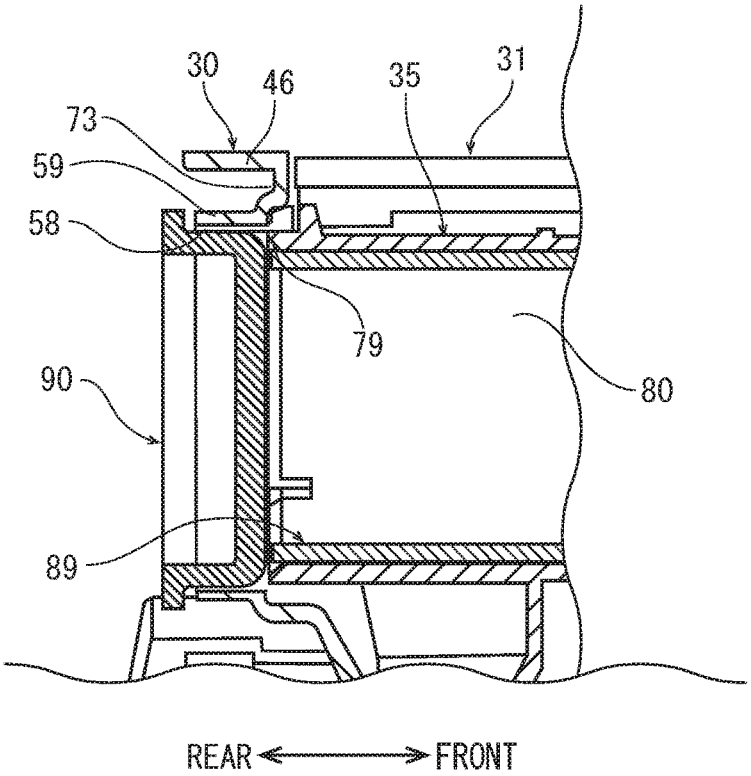
FIG. 9B is a side sectional view showing a state where a toner filling port of the case main body is closed in the toner case according to the embodiment of the present disclosure.

A method of attaching the attachment member 35 to the toner case 6 employing the above-mentioned configuration will be described with reference to FIGS. 6A, 6B, 7, 8, 9A and 9B. FIGS. 6A and 6B are side sectional views showing an engaging state of the toner case and the attachment member, FIG. 7 is a perspective view showing a state where the conveying screw and the agitating paddle are attached to the attachment member, FIG. 8 is a perspective view showing how a closing member is inserted into the duct, FIG. 9A is a side sectional view showing a state where a toner filling port of the case main body is closed by a cap, and FIG. 9B is a side sectional view showing a state where the opening of the attachment member is closed by the closing member.

In order to make toner capacity smaller, the attachment member 35 is attached to the case main body 30 by, as shown in FIG. 6A, engaging the protruded part 54 formed in the bottom plate 41 of the case main body 30 with the recess part 83 formed in the outer circumferential wall 82 of the front plate 72 of attachment member 35 via the sealing member 36. As shown in FIG. 6B, the sealing member 36 is deformed into a downward U shape along a gap between the recess part 83 and the protruded part 54. When the recess part 83 is engaged with the protruded part 54, the opening 79 formed in the rear plate 73 of the attachment member 35 meets the toner filling port 58 formed in the rear plate 43 of the case main body 30.

Figure 7:
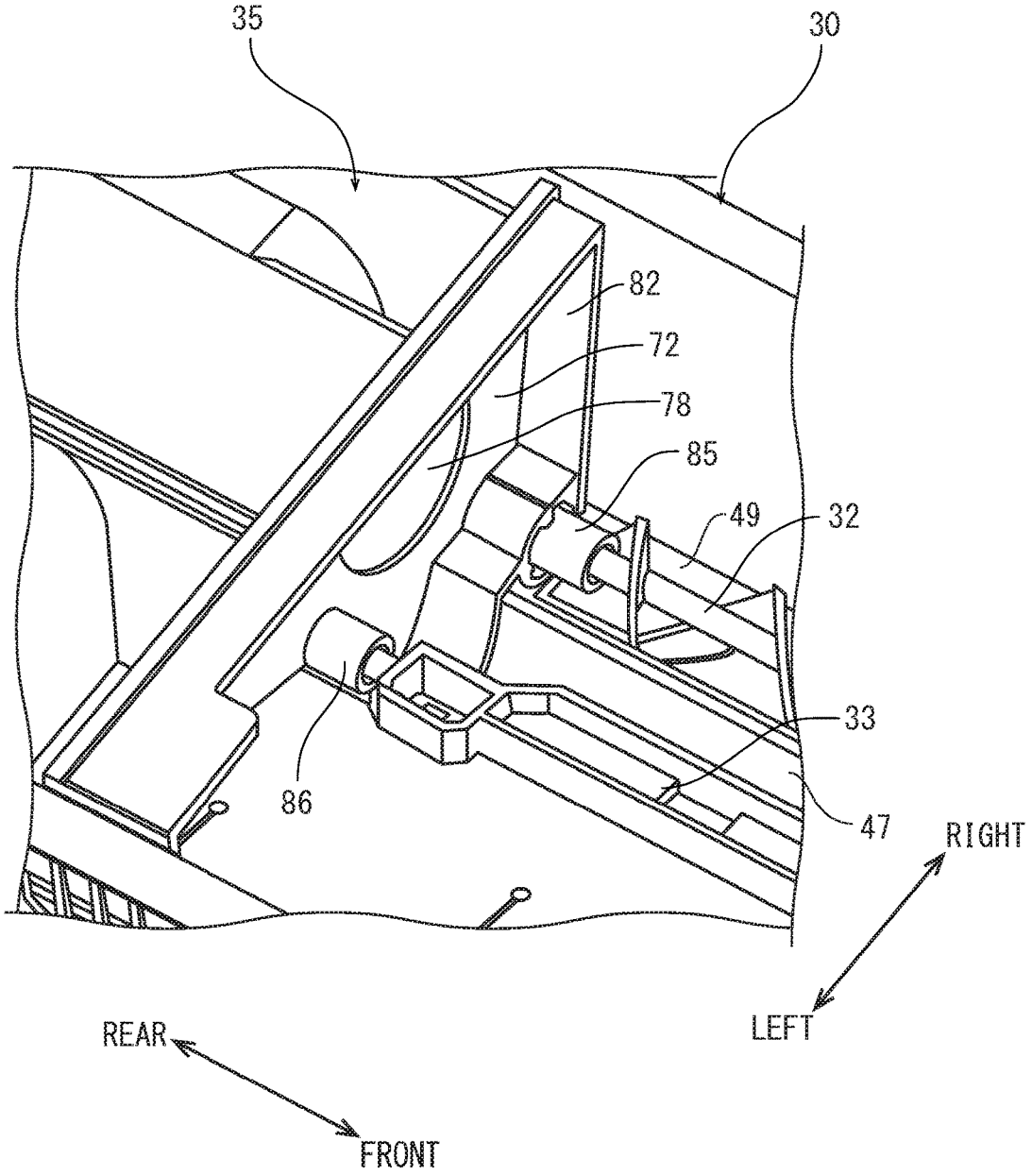
FIG. 7 is a perspective view showing a state where a conveying screw and an agitating paddle are attached to the attachment member in the toner case according to the embodiment of the present disclosure.

After the attachment member 35 is attached, as shown in FIG. 7, above the conveying groove 49 of the step part 47 of the case main body 30, a front end part of the conveying screw 32 is inserted into the toner discharge chamber 48 through the toner conveying opening 51, so that the screw axis hole 85 formed in the front plate 72 of the attachment member 35 and a screw axis hole (not shown) formed in the front plate 42 of the case main body 30 rotatably support both end parts of the rotation axis 61 of the conveying screw 32. Further, the paddle axis hole 86 formed in the front plate 42 of the attachment member 35 and the paddle axis hole 52 formed in the front plate 42 of the case main body 30 rotatably support both end parts of the supporting frame 64 of the agitating paddle 33.

Subsequently, the flange part 31*a* of the lid member 31 is welded to the flange part 46 of the case main body 30. By welding the lid member 31 in this way, the sealing member 36 attached to the entire circumference of the outer circumferential wall 82 of the front plate 72 of the attachment member 35 is arranged between the inner circumferential face of the case main body 30, the inner circumferential face of the lid member 31 and the outer circumferential face of the attachment member 35, so that the sealing member 36 is compressed.

The toner is filled into the filled space S1 of the case main body 30 from the toner filling port 58 formed in the rear plate 43 of the case main body 30 through the duct 80 of the attachment member 35. Thus, during a filling of a toner, the duct 80 communicates the toner filling port 58 and the filled space S1. After a toner of predetermined capacity is filled, as shown in FIG. 8, from the toner filling port 58 of the case main body 30 and through the duct 80 of the attachment member 35, a closing member 89 of a bottomed cylindrical shape is inserted. According to this, as shown in FIG. 9A, the opening 78 formed in the front plate 72 of the attachment member 35 is sealed by a bottom part 89*a* of the closing member 89. Subsequently, as shown in FIG. 9B, to the toner filling port 58 of the case main body 30, a cap 90 is welded.

Incidentally, the restrained space S2 of the case main body 30 is partitioned from the filled space S1 of the case main body 30 by the front plate 72 of the attachment member 35, and therefore a toner is not filled into the restrained space S2 of the case main body 30. That is, the toner is restrained from being filled into the restrained space S2 of the case main body 30. As described above, the attachment member 35 adjusts toner capacity of the case main body 30.

To supply a toner to the development device 12, a shutter is slid by the lever 56 to open the discharge port 55. The conveying screw 32 rotates along the conveying groove 49 formed in the upper face of the step part 47 of the case main body 30, so that the toner is conveyed toward the toner discharge chamber 48 and is supplied from the discharge port 55 to the development device 12. A rotation of the supporting frame 64 rotates the agitating vane 65 along a curved face of the left side plate 44 of the case main body 30, so that the agitating paddle 33 conveys the toner toward the conveying screw 32 while agitating the toner.

As described above, by attaching the attachment member 35 to the toner case 6 according to the present disclosure, it is possible to adjust toner capacity to be contained in the case main body 30, to almost a half. Further, the attachment member 35 and the case main body 30 are positioned by engaging the protruded part 54 and the recess part 83 and, in the gap between the protruded part 54 and the recess part 83, the sealing member 36 deformed into a downward U shape is arranged, so that movement of the attachment member 35 in the front and rear direction is restrained. Furthermore, the sealing member 36 is compressed between the inner circumferential faces of the lid member 31 and the case main body 30, so that movement of the attachment member 35 in an upper and lower direction is also restrained and a sealing property between the attachment member 35 and the case main body 30 improves. Still further, it is possible to prevent the attachment member 35 and the case main body 30 from rattling.

Consequently, it is possible to accurately position the case main body 30 and the attachment member 35, and smoothly fill the toner from the filling port 58 of the case main body 30 through the duct 80 of the attachment member 35. Further, it is possible to prevent leakage of the toner from between the attachment member 35 and the case main body 30, to supply a predetermined amount of the toner from the toner case 6 to the development device 12 and reliably form a predetermined number of images.

Furthermore, the protruded part 54 and the recess part 83 for positioning are formed in the bottom plate 41 of the case main body 30 and the lower face of the outer circumferential wall 82 of the attachment member 35, so that, when the attachment member 35 is attached to the case main body 30, it is easy to adjust positions of the protruded part 54 and the recess part 83 and it is easy to attach the attachment member 35 to the case main body 30.

Still further, the sealing member 36 is arranged between the inner circumferential face of the case main body 30, the inner circumferential face of the lid member 31 and the outer circumferential face of the attachment member 35, so that the sealing member 36 is compressed. By employing such a configuration, it is possible to enhance the sealing property between the inner circumferential faces of the case main body 30 and the lid member 31 and the outer circumferential face of the attachment member 35.

Incidentally, in the present embodiment, the protruded part 54 is formed in the bottom plate 41 of the case main body 30 and the recess part 83 is formed in the outer circumferential wall 82 of the attachment member 35. In other embodiments, the protruded part 54 may be formed in the attachment member 35 and the recess part 83 may be formed in the case main body 30.

Further, in the present embodiment, the configuration of the present disclosure is applied to the printer 1. In other embodiments, the configuration of the present disclosure may be applied to another image forming apparatus other than the printer 1, such as a copying machine, a facsimile or a multifunction peripheral.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A toner case comprising:
a case main body configured to contain a toner;
an attachment member configured to partition an inside space of the case main body so as to adjust toner capacity; and
a sealing member arranged between the case main body and the attachment member,
wherein the case main body includes a first engagement part, and
the attachment member includes a second engagement part configured to engage with the first engagement part via the sealing member,
wherein the first engagement part is a protruded part protruded from an inner circumferential face of the case main body, and
the second engagement part is a recess part arranged on an outer circumferential face of the attachment member, and
the sealing member is configured to cover the recess part along the outer circumferential face of the attachment member and is deformed into a shape along a gap between the protruded part and the recess part.

2. The toner case according to claim 1, wherein the first engagement part and the second engagement part extend along a direction crossing to a longitudinal direction of the case main body.

3. An image forming apparatus comprising the toner case according to claim 1.

4. A toner case comprising:
a case main body configured to contain a toner;
an attachment member configured to partition an inside space of the case main body so as to adjust toner capacity; and
a sealing member arranged between the case main body and the attachment member,
wherein the case main body includes a first engagement part, and
the attachment member includes a second engagement part configured to engage with the first engagement part via the sealing member,
wherein the case main body has an opening at its upper face, and
the first engagement part is formed at a lower part of an inner circumferential face of the case main body, and the second engagement part is formed at a lower part of an outer circumferential face of the attachment member.

5. The toner case according to claim 4, further comprising a lid member configured to close the opening of the case main body,
wherein the sealing member is arranged between inner circumferential faces of the case main body and the lid member and the outer circumferential face of the attachment member so that the sealing member is compressed.

6. An image forming apparatus comprising the toner case according to claim 4.

7. A toner case comprising:
a case main body configured to contain a toner;
an attachment member configured to partition an inside space of the case main body so as to adjust toner capacity; and
a sealing member arranged between the case main body and the attachment member,
wherein the case main body includes a first engagement part, and
the attachment member includes a second engagement part configured to engage with the first engagement part via the sealing member,
wherein the case main body includes an outer plate having a toner filling port, and
the attachment member includes:
a partition plate configured to partition the inside space of the case main body into a filled space filled with the toner and a restrained space restrained from a filling of the toner; and
a duct arranged between the outer plate and the partition plate, housed in the restrained space, and configured to communicate the toner filling port and the filled space while the toner is filled into the filled space, and
the sealing member is arranged along an outer circumferential face of the partition plate.

8. The toner case according to claim 7, further comprising a rotating member housed in the filled space,
wherein the partition plate includes a bearing part configured to rotatably support one end part of the rotating member.

9. The toner case according to claim 7, wherein the sealing member is wound around the outer circumferential face of the partition plate, and both end parts of the sealing member in a longitudinal direction are overlapped with each other in a longitudinal direction of the case main body.

10. An image forming apparatus comprising the toner case according to claim 7.

* * * * *